US007637853B2

(12) United States Patent
Crowson et al.

(10) Patent No.: US 7,637,853 B2
(45) Date of Patent: Dec. 29, 2009

(54) CONDITIONING AND EXERCISING DEVICE

(75) Inventors: Joel L. Crowson, Bossier City, LA (US); Neal W. Chandler, Shreveport, LA (US)

(73) Assignee: Titan Athletic Group, Corp., Williamsburg, VA (US)

( * ) Notice: Subject to any disclaimer, the term of this patent is extended or adjusted under 35 U.S.C. 154(b) by 8 days.

(21) Appl. No.: 11/202,150

(22) Filed: Aug. 11, 2005

(65) Prior Publication Data

US 2006/0035770 A1 Feb. 16, 2006

Related U.S. Application Data

(60) Provisional application No. 60/601,473, filed on Aug. 16, 2004.

(51) Int. Cl.
*A63B 21/045* (2006.01)

(52) U.S. Cl. ..... 482/127

(58) Field of Classification Search ..... 482/92, 482/110, 114–116, 120–127, 1, 72; 273/317, 273/317.2, 317.6–317.9, 329–330; 473/138–139, 473/142, 219, 226–229, 257–258, 442–423, 473/431; 474/4, 7, 10, 64; 242/373, 375; 403/62, 70, 79, 91, 111–113, 119, 121, 150–159, 403/161; 119/796; *A63B 21/02*
See application file for complete search history.

(56) References Cited

U.S. PATENT DOCUMENTS

| | | | | |
|---|---|---|---|---|
| 1,137,349 | A | 4/1915 | Patterson | |
| 2,134,451 | A | 10/1938 | Mogren | 272/57 |
| 2,455,707 | A | 12/1948 | Sheffer | 273/35 |
| 2,655,378 | A | 10/1953 | Sheffer | 273/35 |
| 2,848,234 | A | 8/1958 | Brandon | 273/35 |
| 3,083,016 | A | 3/1963 | Sumegi | 273/35 |
| 3,400,933 | A | 9/1968 | Heiser | 273/186 |
| 3,604,712 | A | 9/1971 | Prier | 273/186 |
| 3,618,942 | A | 11/1971 | Bates | 272/82 |
| 3,804,420 | A | 4/1974 | Boyd | 273/183 B |
| 3,966,203 | A | 6/1976 | Bickford | 272/118 |
| 4,010,948 | A * | 3/1977 | Deluty | 482/120 |
| 4,135,714 | A | 1/1979 | Hughes | 272/136 |

(Continued)

*Primary Examiner*—Loan H Thanh
*Assistant Examiner*—Oren Ginsberg
(74) *Attorney, Agent, or Firm*—Bambi Faivre Walters

(57) ABSTRACT

A conditioning and exercising device which is characterized in a preferred embodiment by a rewind housing containing a rotatable pulley provided with a pull cord, which rewind housing is connected to a torsion spring or spool housing. The rotatable pulley is connected to a rotatable top spool connected to a torsion spring wound on a rotatably mounted bottom spool, also connected to the torsion spring, both spools of which are located in the spool housing. Accordingly, extension of the pull cord and rotation of the rewind housing pulley against the tension in the torsion spring wound on the bottom spool as the torsion spring reverse-winds on the top spool, facilitates an increasing tension in the pull cord. In another embodiment the pull cord is wound directly on the rotatable top spool and is unwound against the tension in the torsion spring as the torsion spring reverse-winds from the bottom spool onto the top spool. In both embodiments the pull cord can be attached to the leg or foot of a user or to a bat or a handle or grip for gripping by a user and exercising against the tension supplied by the torsion spring.

4 Claims, 10 Drawing Sheets

U.S. PATENT DOCUMENTS

| | | | | |
|---|---|---|---|---|
| 4,174,832 | A | 11/1979 | Thompson | 272/133 |
| 4,229,002 | A | 10/1980 | Masters | 272/117 |
| 4,238,964 | A | 12/1980 | Wolf | 73/714 |
| 4,243,219 | A | 1/1981 | Price | 272/117 |
| 4,600,190 | A | 7/1986 | Berokoff | 272/136 |
| 4,728,102 | A | 3/1988 | Pauls | 272/132 |
| 4,944,511 | A * | 7/1990 | Francis | 482/123 |
| 4,974,836 | A | 12/1990 | Hirsch | 272/117 |
| 5,072,934 | A | 12/1991 | Blanes | 272/117 |
| 5,082,262 | A | 1/1992 | Sanchez | 273/26 |
| 5,226,867 | A * | 7/1993 | Beal | 482/127 |
| 5,269,512 | A | 12/1993 | Crowson et al. | 273/26 R |
| 5,924,966 | A | 7/1999 | Havlovic | 482/129 |
| 6,413,196 | B1 | 7/2002 | Crowson | 482/118 |
| 6,685,602 | B2 * | 2/2004 | Colosky et al. | 482/127 |
| 2003/0153441 | A1 * | 8/2003 | Berns et al. | 482/128 |

* cited by examiner

CONDITIONING AND EXERCISING DEVICE

CROSS-REFERENCE TO RELATED APPLICATIONS

This application claims the benefit of and incorporates by reference prior filed copending U.S. Provisional Application Ser. No. 60/601,473, Filed Aug. 16, 2004.

SUMMARY OF THE INVENTION

This invention relates to spring-operated exercising devices and more particularly, to a conditioning and exercising device for use in such applications as conditioning the arms and shoulders, as well as the torso and legs of pitchers and batters in the games of baseball and softball. The conditioning and exercising device is also effective for any application of conditioning and exercising wherein it is desired to work one or both arms or legs against a load supplied by a spring, responsive to extension and retraction of a pull cord or cable associated with the spring. In a preferred embodiment the conditioning and exercising device of this invention is characterized by a split rewind housing fitted with an internally rotatable rewind sheave or pulley and provided with a pull cord, rope or cable which may be extended and retracted from and into the rewind housing responsive to spring tension. Exercising tension is supplied by a torsion spring connected to a top spool and wound on a bottom spool located inside a torsion spring or spool housing, to which the rewind housing is attached. In a typical embodiment the rewind pulley is mounted on a drive shaft attached to the top spool and extending from the spool housing into the rewind housing, such that extension of the pull cord and rotation of the rewind pulley in the rewind housing causes the torsion spring to unwind from the bottom spool and reverse-wind in the opposite direction on the top spool, causing tension in the pull cord. Attachment of a bat to the pull cord thus facilitates batting practice against a load as the pull cord is extended from the rewind housing responsive to rotation of the rewind pulley against the tension in the torsion spring located inside the spool housing. Alternatively, a handle or grip of suitable design may be attached to the extending end of the pull cord and arm and shoulder exercises effected by extending the pull cord from the rewind housing against the tension in the torsion spring by arm and shoulder action. The rewind housing is typically fitted with an internal pulley spring to facilitate maintaining the pulley rotatably in proper rewind position inside the rewind housing. A stabilizing pin mechanism may also be provided in the rewind housing for selectively engaging the spool housing and stabilizing the rewind housing on the spool housing when the pull cord is extended from the rewind housing.

In a second preferred embodiment of the invention the pull cord is attached directly to the top spool and extends from the housing for attachment to a bat, grip or handle, in non-exclusive particular. A force applied to the pull cord thus causes the torsion spring to unwind from the bottom spool and reverse-wind on the top spool and tension the pull cord in the same manner as described above with respect to the first embodiment of the invention.

BRIEF DESCRIPTION OF THE DRAWINGS

The invention will be better understood by reference to the accompanying drawings wherein.

DESCRIPTION OF THE PREFERRED EMBODIMENTS

Figure 1:
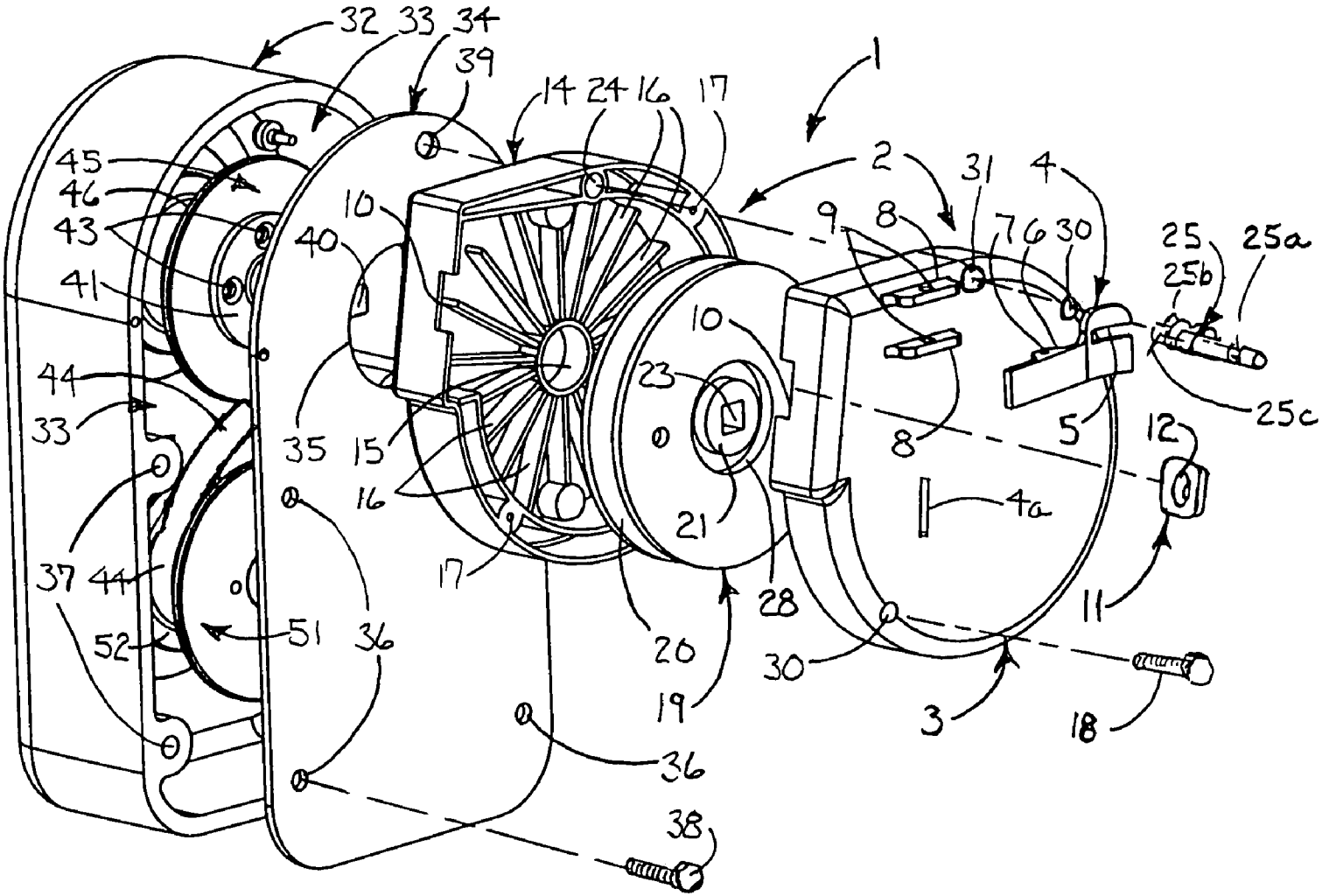
FIG. 1 is a front exploded view of a first preferred embodiment of the pitching and batting conditioning device of this invention.
Figure 2:
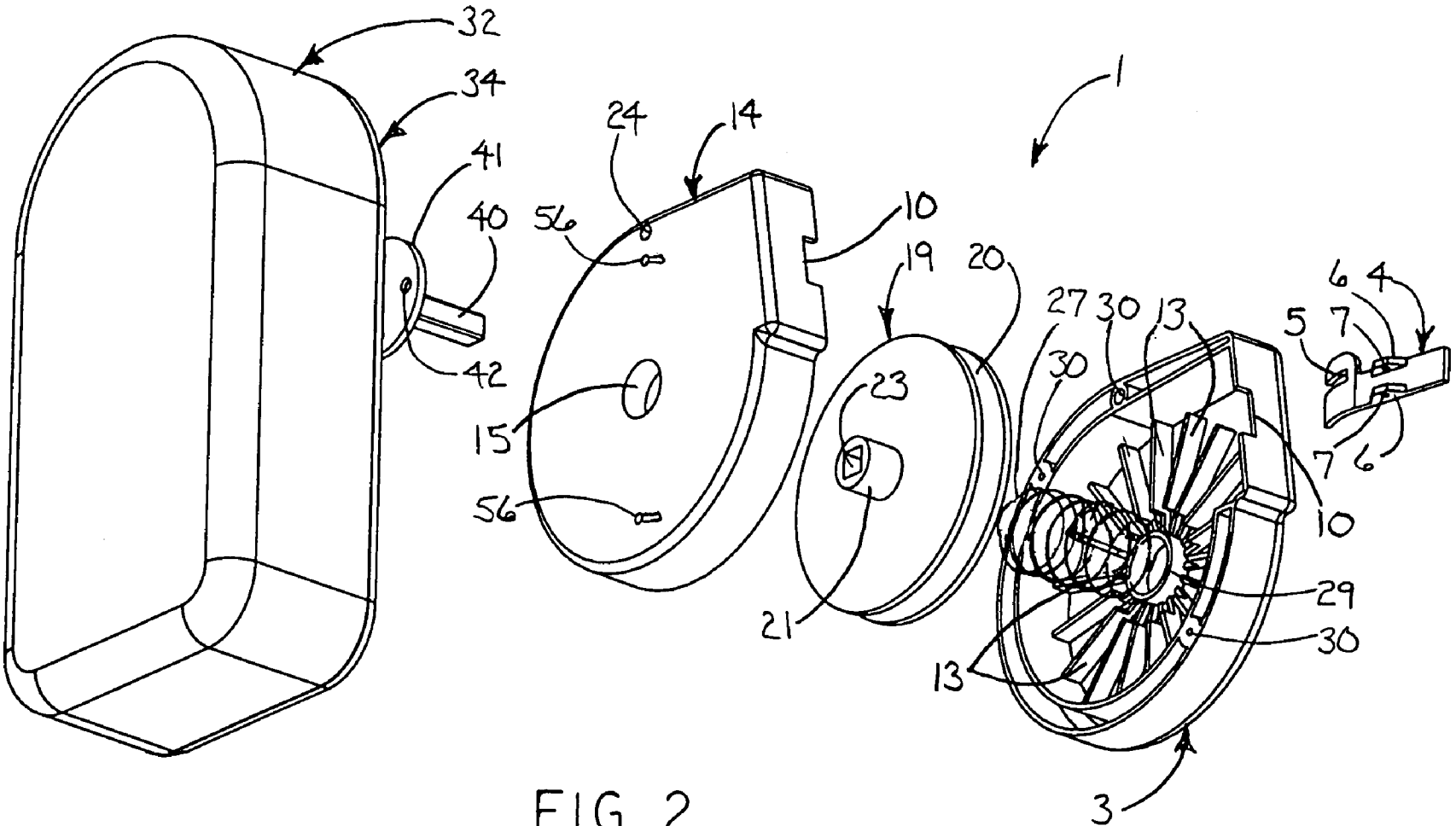
FIG. 2 is a rear exploded view of the pitching and batting conditioning device illustrated in FIG. 1.
Figure 3:
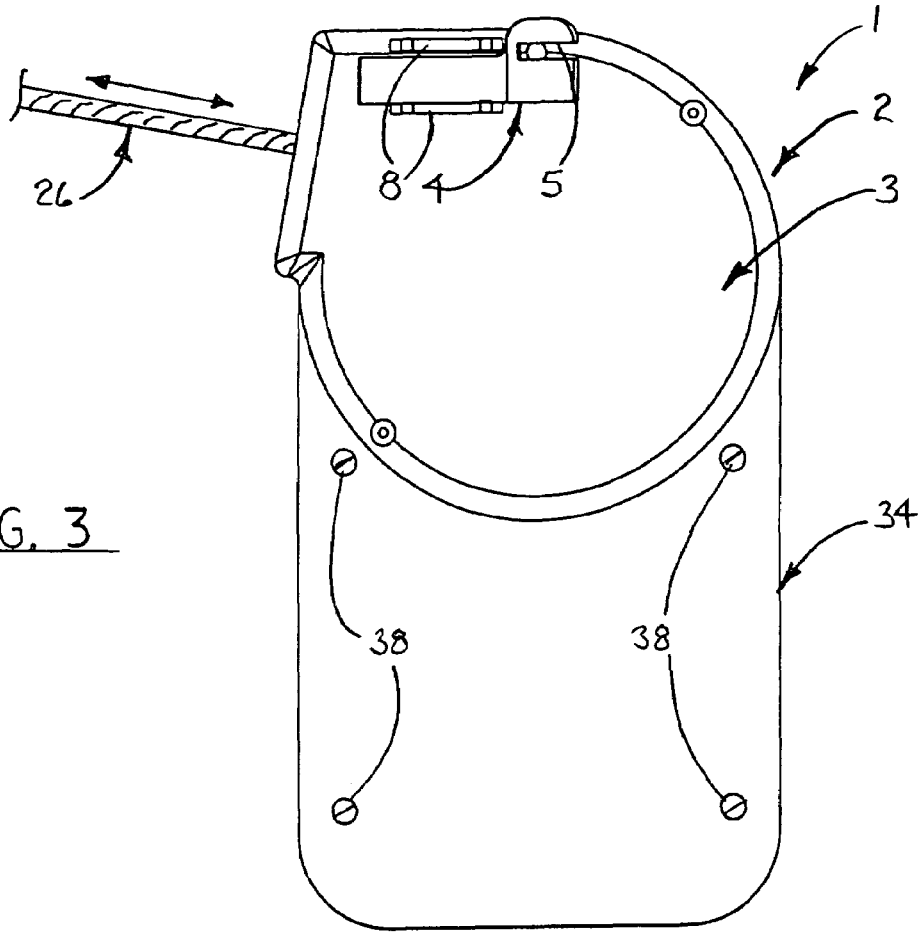
FIG. 3 is a front view of the pitching and batting conditioning device illustrated in FIGS. 1 and 2.
Figure 4:
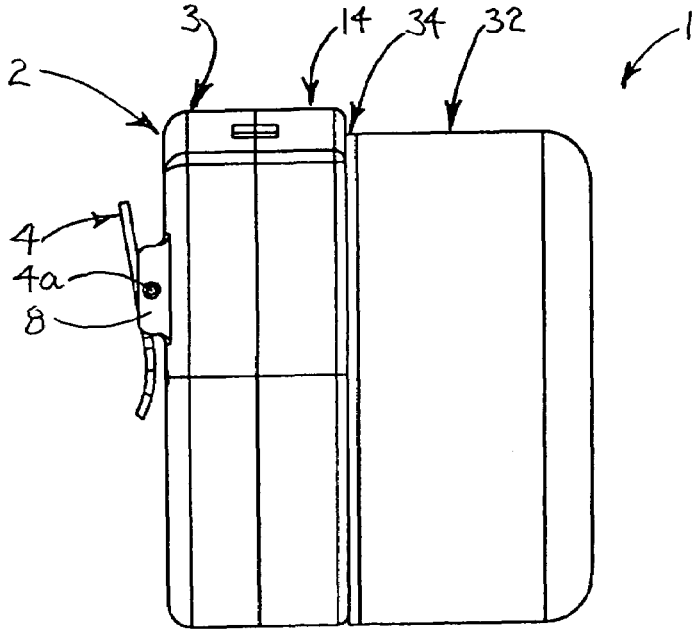
FIG. 4 is a top view of the pitching and batting conditioning device illustrated in FIG. 3.
Figure 8:
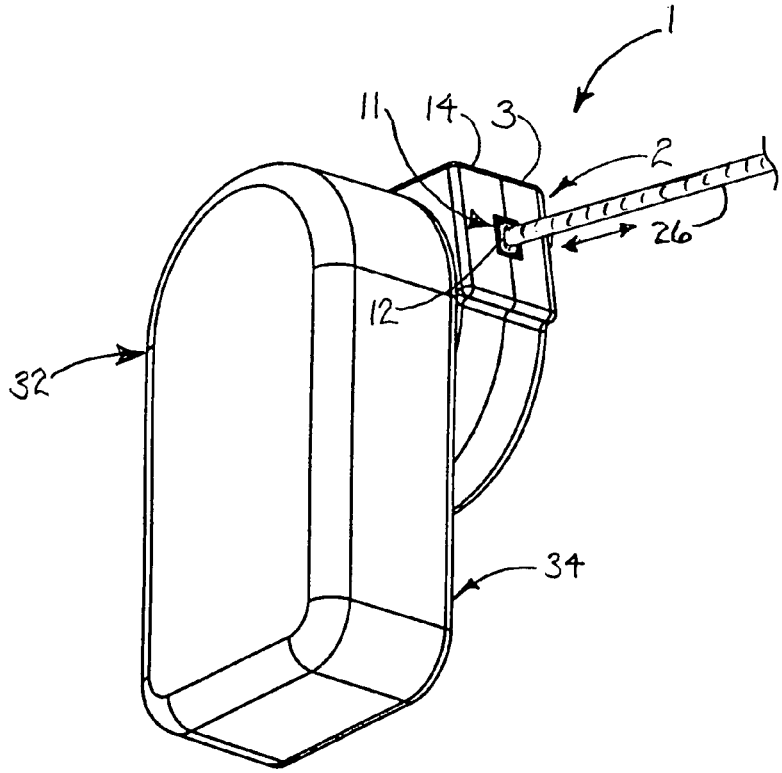
FIG. 8 is a rear perspective view of the assembled pitching and batting conditioning device illustrated in FIGS. 3-5.

Referring initially to FIGS. 1, 2 and 8 of the drawings in a preferred embodiment the conditioning and exercising device of this invention is generally illustrated by reference numeral 1. The conditioning and exercising device 1 is typically characterized by a split rewind housing 2 which is defined by an outside housing 3 and an inside housing 14, connected by spaced-apart rewind housing mount bolts 18, one of which is illustrated in FIG. 1. The outside housing 3 further includes a rocker arm 4 fitted with a rocker arm slot 5 at one end and having a rocker arm pivot 6 that extends between a pair of rocker arm mounts 8 on the outside housing 3. The rocker arm pivot 6 is pivotally attached to the rocker arm mounts 8 by means of a rocker arm pin 4*a* (FIG. 1) which extends through aligned and spaced-apart rocker arm mount openings 9 provided in the rocker arm mounts 8 and the rocker arm pivot openings 7 provided in the rocker arm pivot 6 of the rocker arm 4.

A stabilizing pin 25 has a stabilizing pin groove 25*a* pin one end for seating in the rocker arm slot 5 when the stabilizing pin 25 is inserted in the registering outside housing pin opening 31, the inside housing pin opening 24 and the pin lock opening 39 in a torsion spring or spool housing 32 (FIG. 1). A stabilizing pin spring 25*b* is fitted on the stabilizing pin 25 above a roll pin 25*c*, extending transversely through the stabilizing pin 25, for purposes hereinafter described. In a preferred embodiment matching cord insert slots 10 are provided in both the outside housing 3 and the inside housing 14 in facing relationship and together receive a cord insert 11, fitted with a cord insert opening 12, for receiving the extending end of a pull cable or cord 26, as illustrated in FIG. 8 of the drawings. A bat or handle (not illustrated) can be attached to the extending end of the pull cord 26 for gripping and exercising as the pull cord 26 is extended from the split rewind housing 2 through the cord insert opening 12 of the cord insert 11, as hereinafter further described. The outside housing 3 of the split rewind housing 2 is also typically fitted with outside bearing vanes 13 on the interior thereof (FIG. 2) and in like manner, the inside housing 14 has inside housing vanes 16 provided on the interior thereof in facing relationship with respect to the outside bearing vanes 13, as further illustrated in FIG. 1 of the drawings. The inside housing 14 is further fitted with an inside housing opening 15 for rotatably receiving the projecting pulley shaft 21 of a rewind pulley 19, which is rotatably positioned in the split rewind housing 2 between the outside housing 3 and the inside housing 14, as further illustrated in FIGS. 1 and 2 of the drawings. The rewind pulley 19 has a circumferential pulley groove 20 for receiving the pull cord 26, as further illustrated in FIG. 8. Inside housing bolt openings 17 in the inside housing 14 register with corresponding outside housing bolt openings 30 in the outside housing 3 for receiving corresponding rewind housing mount bolts 18, as further illustrated in FIG. 1 of the drawings. A pulley spring 27 is disposed in reverse-wind configuration inside the split rewind housing 2, between the rewind pulley 19 and the outside housing 3, for application of tension to the rewind pulley 19 when the split rewind housing 2 is assembled as illustrated in FIG. 8 of the drawings. A washer (not illustrated) may be provided in the pulley spring seat 28, which receives one end of the pulley spring 27 and a pulley spring mount 29 receives the opposite end of the pulley spring 27.

Figure 6:
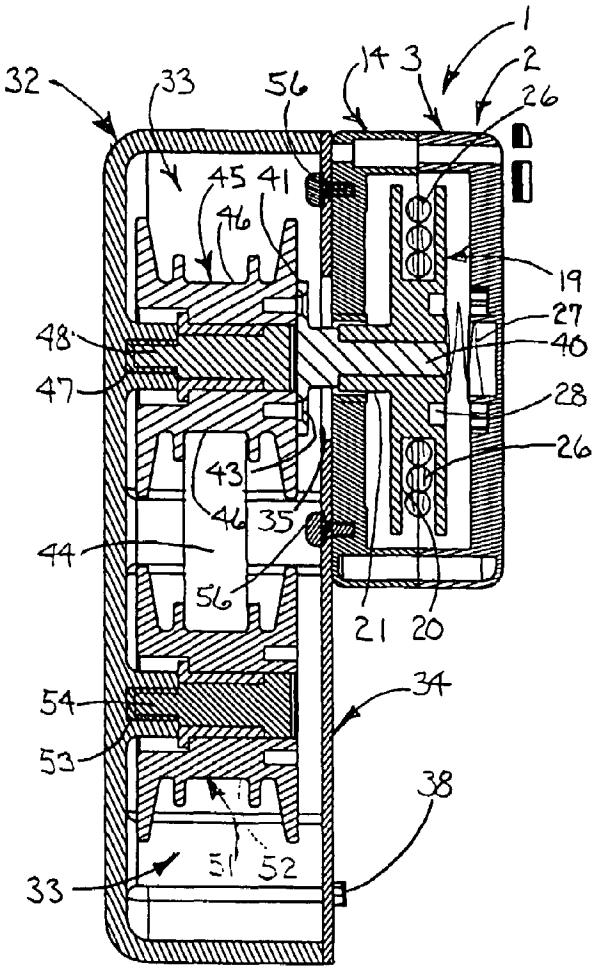
FIG. 6 is a sectional view taken along line 6-6 of the pitching and batting conditioning device illustrated in FIG. 5.
Figure 5:
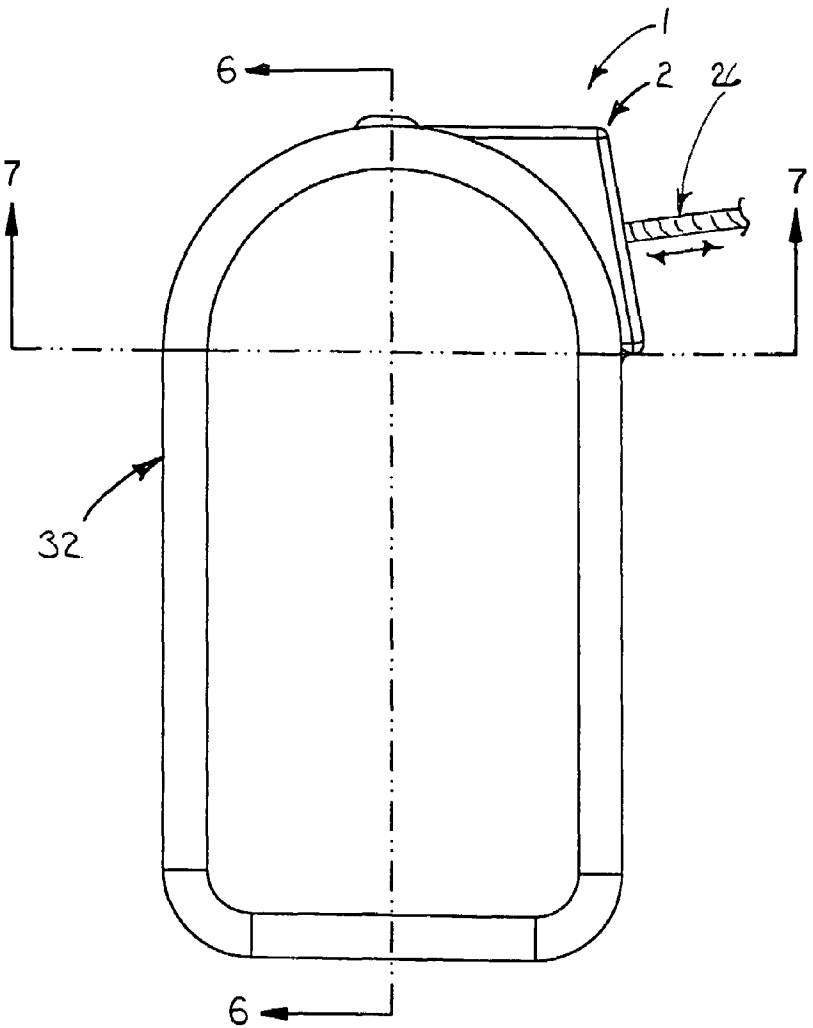
FIG. 5 is a rear view of the pitching and batting conditioning device illustrated in FIG. 3.
Figure 7:
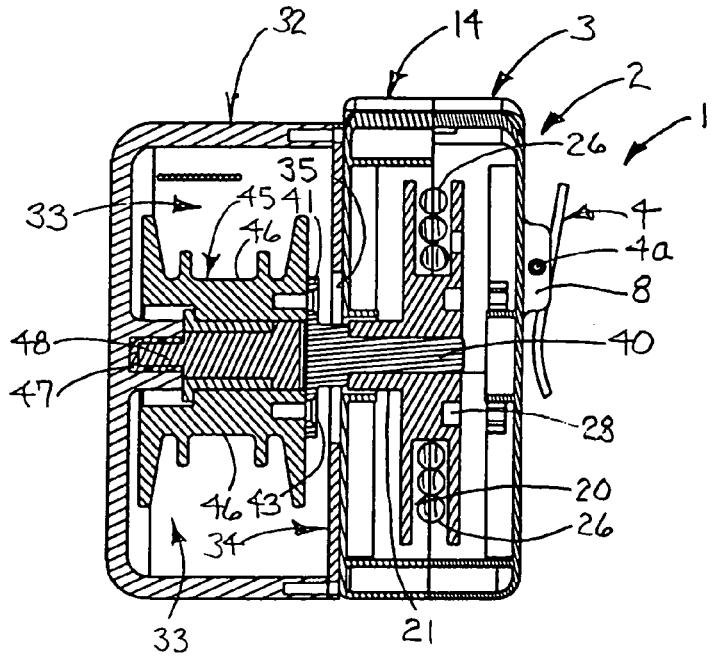
FIG. 7 is a sectional view taken along line 7-7 of the pitching and batting conditioning device illustrated in FIG. 5.

As further illustrated in FIGS. 1, 2, 6 and 7 of the drawings the torsion spring spool housing 32 is fitted with a removable housing plate 34 that closes a housing cavity 33, receiving a top spool 45 and a bottom spool 51, as illustrated in FIG. 1. One end of a torsion spring 44 is fixed to the base of the top spool groove 46 of the top spool 45 in any convenient fashion, such as a slot (not illustrated) and is wound on the bottom spool 51 in a corresponding aligned bottom spool groove 52. The top spool 45 is typically rotatably seated or mounted in a top spool bushing or bearing 47 by means of a top spool shaft 48, while the bottom spool 51 is similarly rotatably seated or mounted on a bottom spool bushing or bearing 53 by means of a bottom spool shaft 54, as further illustrated in FIGS. 1, 2, 6 and 7 of the drawings. A drive shaft 40, typically having a square cross-sectional configuration, is secured, typically by means of a drive shaft mount 41, to the center area of the top spool 45. The drive mount shaft 41 is provided with drive shaft mount openings 42 (FIG. 2) and drive shaft mount bolts 43 are typically used to removably secure the drive shaft 42 to the top spool 45, as illustrated in FIGS. 6 and 7 of the drawings. The drive shaft 40 projects from the housing cavity 33 of the spool housing 32 through a housing plate opening 35 located in the housing plate 34 and into the split rewind housing 2 through the inside housing opening 15 of the inside housing 14. There it mounts the rewind pulley 19 by extension through the corresponding shaped drive shaft receptacle 23 provided in the pulley shaft 21 at the center of the rewind pulley 19, as further illustrated in FIGS. 1, 6 and 7 of the drawings. The housing plate 34 is typically attached to the torsion spring housing 32 by means of housing plate bolts 38, which extend through corresponding housing plate mount openings 36, located in the housing plate 34 and thread into the corresponding threaded housing bolt seats 37 in the spool housing 32.

In operation, the first preferred embodiment of the conditioning and exercising device 1 of this invention is used as follows. Under circumstances where the conditioning and exercising device 1 is to be utilized in connection with a bat (not illustrated) for batting swing practice along with arm and shoulder strengthening purposes, the extending end of the pull cord 26 is attached by any convenient means to the bat, typically by using a strap or a screw eye and clip or the like (not illustrated) such that the bat can be gripped and the pull cord 26 extended from the rewind housing 2 through the cord insert opening 12 of the cord insert 11 by arm and shoulder action. As the pull cord or cable 26 extends from the split rewind housing 2, the rewind pulley 19 is rotated inside the split rewind housing 2 and this action rotates the drive shaft 40 and top spool 45 in the spool housing 32. The split rewind housing 2 is stabilized on the spool housing 32 during this action by means of the stabilizing pin 25, the bottom end of which is seated in the pin lock opening 39 of the spool housing 32. Since one end of the torsion spring 44 is connected to the top spool 45 in the top spool groove 46, the torsion spring 44 begins to reverse-wind under increasing tension on the top spool 45 from the bottom spool 51, as further illustrated in FIG. 1 of the drawings. Continued extension of the pull cord 26 from the interior of the split rewind housing 2 and continued rotation of the rewind pulley 19 effects increasing tension in the pull cord 26 by the growing tension in the reverse-wound torsion spring 44 as the torsion spring 44 unwinds from the bottom spool groove 52 of the bottom spool 51 and winds in the opposite direction onto the top spool groove 46 of the top spool 45. This tension in the pull cord 26 and the torsion spring 44 increases to a maximum when the pull cord 26 is fully extended from the split rewind housing 2. Release of tension from the bat and therefore from the pull cord 26, facilitates rewinding of the pull cord 26 into the split rewind housing 2 on the pulley groove 20 of the rewind pulley 19, responsive to unwinding of the torsion spring 44 from the top spool 45 and rewinding back onto the bottom spool 51. Repetitively swinging the bat against the tension in the pull cord 26 thus effects a desired degree of resistance in the arms, torso, legs and shoulders of the user. This exercising tension and resistance can be adjusted by selecting a set of the top spool 45 and bottom spool 51 with a connecting torsion spring 44 having a desired tension for introduction into the spool housing 32.

Accordingly, it is understood that various sets of the top spool 45, bottom spool 51 and the connecting spool spring 44 of desired strength and tension can be individually mounted in the spool housing 32 by removing the housing plate bolts 38 and the housing plate 34, along with the split rewind housing 2, from the spool housing 32, thus providing access to the housing cavity 33 and the top spool 45, as well as the bottom spool 51. Furthermore, the split rewind housing 2 can be removed from the spool housing 32 by first depressing the rocker arm 4 and lifting the end of the stabilizing pin 25 from the pin lock opening 39 against the tension in the stabilizing spring pin 25*b*. Final removal of the split rewind housing 2 is effected by twisting the split rewind housing 2 and removing the bayonet tabs 56 from corresponding bayonet slots (not illustrated) which may be provided in the housing plate 34 (FIG. 2). The drive shaft 40 can then be unbolted from the top spool 45 by removing the corresponding drive shaft mount bolts 43, if desired, to remove the drive shaft mount 41 and accompanying drive shaft 40 from the top spool 45. Alternatively, a replacement top spool 45 and bottom spool 51 combination with a torsion spring 44 of desired strength can be mounted in the spool housing 32 with a second drive shaft mount 41 and drive shaft 40 already in place, as desired.

Accordingly, each top spool 45, bottom spool 51 and connecting torsion spring 44 set can be quickly and easily removed from the respective top spool bearing 47 and bottom spool bearing 53 and the replacement top spool 45 and bottom spool 51 and torsion spring 44 combination installed in the spool bearing 47 and bottom spool bearing 53, as desired. The split rewind housing 2 can then be replaced on the spool housing 32 and secured in place, typically using the bayonet tabs 56, such that the conditioning and exercising device 1 is in operating configuration with a torsion spring 44 of selected tension.

Figure 9:
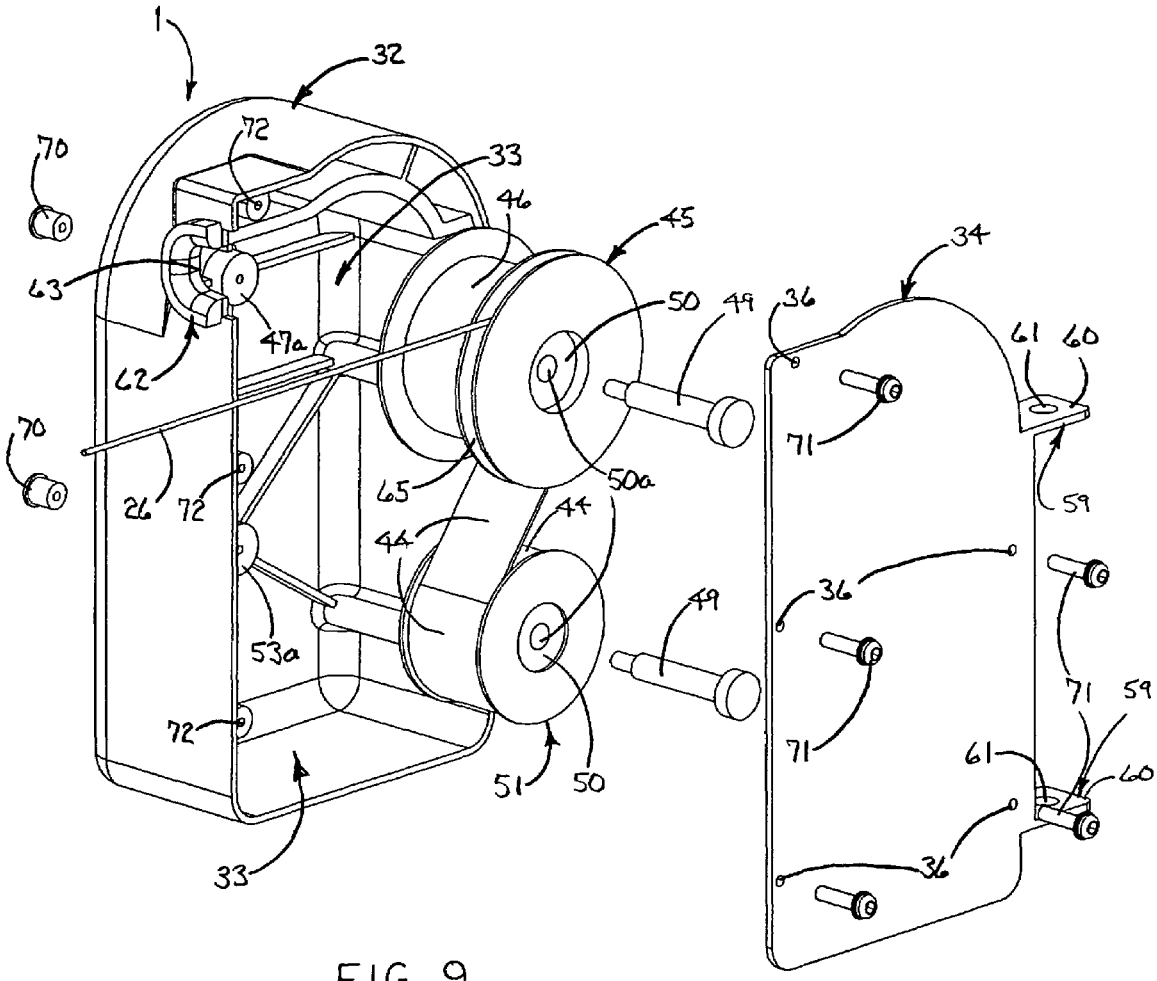
FIG. 9 is an exploded view of a second preferred embodiment of the pitching and batting conditioning device of this invention.
Figure 10:
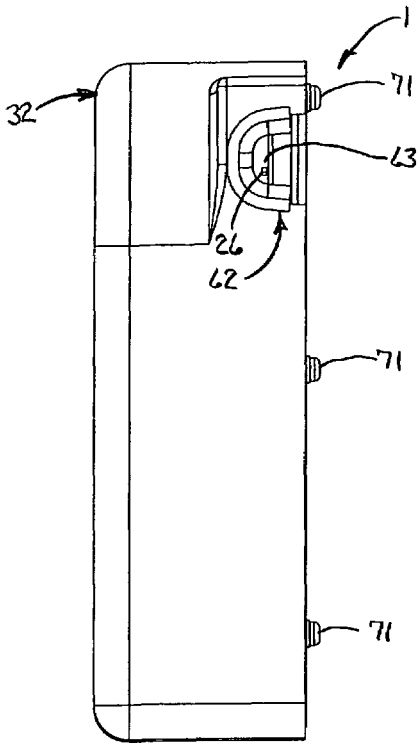
FIG. 10 is a left side elevation of the pitching and batting conditioning device illustrated in FIG. 9.
Figure 11:
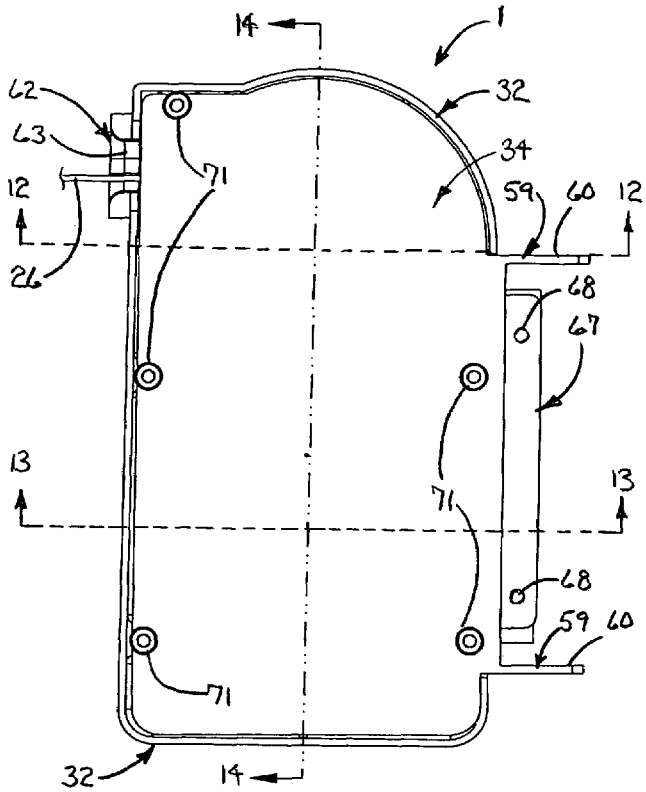
FIG. 11 is a front view of the pitching and batting conditioning device illustrated in FIGS. 9 and 10.
Figure 12:
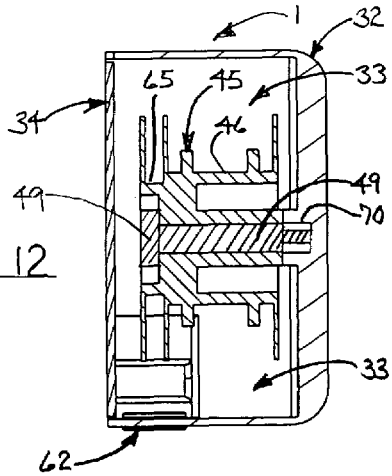
FIG. 12 is a sectional view taken along line 12-12 of the pitching and batting conditioning device illustrated in FIG. 11 with the torsion spring removed.
Figure 13:
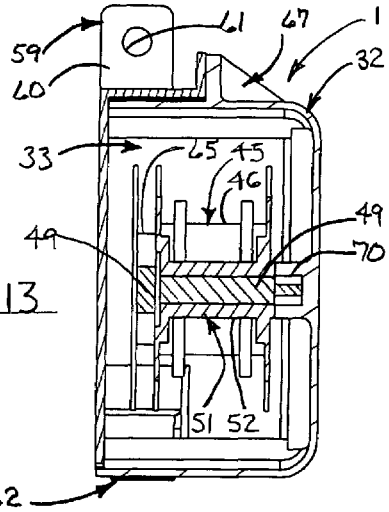
FIG. 13 is a sectional view taken along line 13-13 of the pitching and batting conditioning device illustrated in FIG. 11 with the torsion spring removed.
Figure 14:
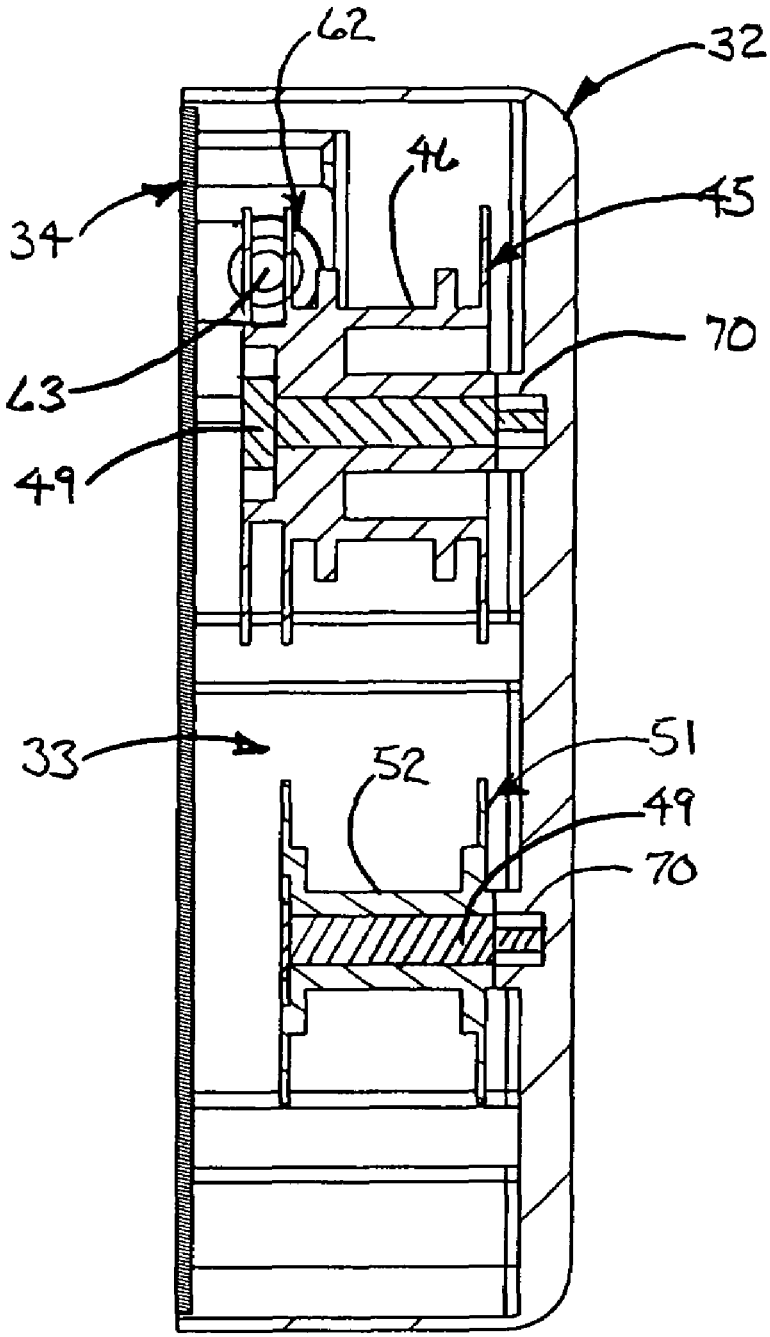
FIG. 14 is a sectional view taken along line 14-14 of the pitching and batting conditioning device illustrated in FIG. 1I with the torsion spring removed.

In another preferred embodiment of the invention the conditioning and exercising device 1 is illustrated in FIGS. 9-16 of the drawings and includes a torsion spring spool housing 32 having a housing cavity 33 and closed by a housing plate 34, typically using cap screws 71, extending through housing plate mount openings 36 and into internally-threaded cap screw seats 72, as illustrated in FIG. 9. As in the case of the first embodiment of the invention described above with respect to FIGS. 1-8, a top spool 45 is rotatably seated in the housing cavity 33, typically by means of a spool mount bolt 49, which threads into an internally-threaded insert 70, seated in a top spool bushing or bearing mount 47*a,* molded in or otherwise provided on the torsion spring spool housing 32. In similar manner, a bottom spool 51 is rotatably mounted in spaced-apart relationship with respect to the top spool 45 in the housing cavity 33 by means of a second spool mount bolt 49 that threads into a second internally-threaded mount 70, seated in a corresponding bottom spool bushing or bearing mount 53*a,* similarly provided in the torsion spring spool housing 32. Further as in the case of the first embodiment illustrated in FIGS. 1-8 of the drawings, a reverse-wound torsion spring 44 is wound on the bottom spool 51 and connects the top spool 45 to the bottom spool 51 in any convenient manner for exerting tension on both the top spool 45 and the bottom spool 51, as described above with respect to FIGS. 1-8 of the drawings. As further illustrated in FIGS. 12-14 of the drawings, the top spool 45 is further fitted with a cord wind groove 65 that anchors and accommodates a pull cord or cable 26, such that the pull cord 26 rewinds on the top spool 45 in the cord wind groove 65 against the tension in the torsion spring 44. Furthermore, the pull cord 26 extends through a guide opening 63 provided in a "C"-shaped cable guide 62 fitted in the torsion spring spool housing 32, as further illustrated in FIGS. 9-14 of the drawings. Accordingly, extension of the pull cord 26 from the torsion spring spool housing 32 and corresponding rotation of the top spool or sheave 45 and the bottom spool or sheave 51 extends the pull cord 26 from the torsion spring spool housing 32 and through the guide opening 63 of the cord guide 62, against the tension in the reverse-wound torsion spring 44, for exercising purposes.

Figure 15:
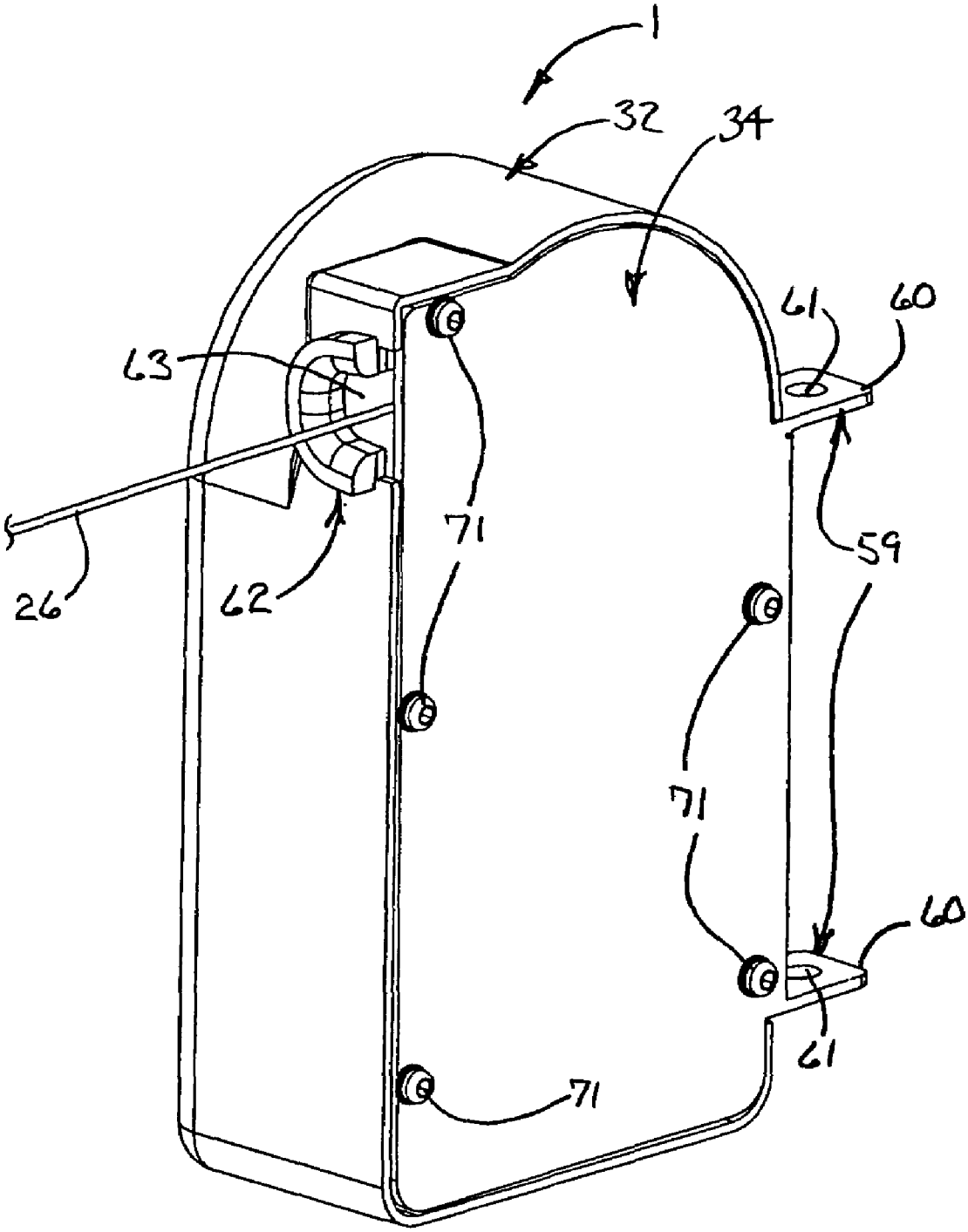
FIG. 15 is a front perspective view of the second embodiment of the pitching and batting conditioning device of this invention.
Figure 16:
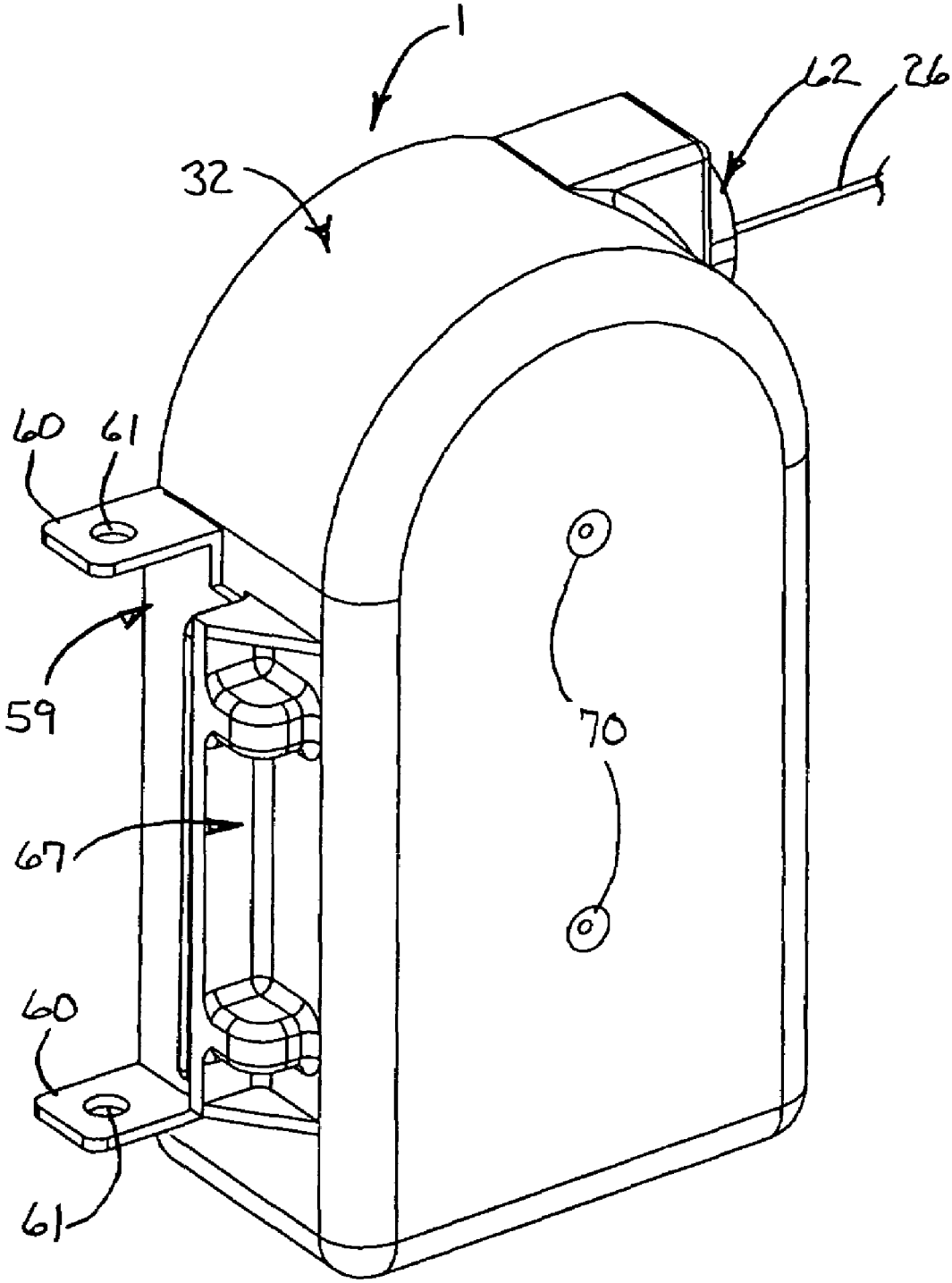
FIG. 16 is a rear perspective view of the pitching and batting conditioning device illustrated in FIG. 15.

Referring now to FIGS. 15 and 16 of the drawings, in a preferred embodiment a first housing mount bracket 59, provided with outwardly-extending bracket legs 60, each having a leg opening 61, is provided on the torsion spring spool housing 32 for mounting the conditioning and exercising device 1 on a fixed object such as a wall, bracket or the like (not illustrated). A second housing mount bracket 67 is typically also provided on or molded, in the torsion spring spool housing 32 and includes bracket openings 68 for receiving mount bolts (not illustrated) and mounting the torsion spring spool housing 32 on a fixed object.

It will be appreciated by those skilled in the art that a wide variety of top spool 45, bottom spool 51 and torsion spring 44 combinations of selected tension can be made available for use in a common torsion spring spool housing 32 in both of the embodiments detailed above. Furthermore, various types of handles and gripping devices known to those skilled in the art can be easily attached to the pull cord 26 using connectors of known design to facilitate extension of the pull cord or cable 26 from the torsion spring spool housing 32 against a selected torsion spring 44 tension for exercising the arms, torso, legs and shoulders with or without the use of a bat.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A conditioning and exercising device comprising:

a spool housing having a removable housing plate;

a removable set of spools having a first spool configured for rotation in said spool housing, a second spool configured for rotation in said spool housing and a torsion spring wound on said second spool and directly coupled to said first spool;

a rewind housing removably attached to said spool housing immediately adjacent and directly to said removable housing plate and configured to house a pulley therein;

a pull cord having a free end extending through said rewind housing, said pull cord wound on said pulley and configured to rotate said first spool and said pulley in concert, wherein extension of said pull cord from said pulley rotates said first spool and said second spool against the bias of said torsion spring as said torsion spring unwinds from said second spool and reverse-winds on said first spool and applies tension to said pull cord; the rewind housing comprises a split rewind housing, the split rewind housing comprises: an outside housing member; and an inside housing member connected by spaced-apart rewind housing mount bolts to said outside housing member; the split rewind housing further comprises: a rocker arm coupled to the outside housing member, the rocker arm being fitted with a rocker arm slot at one end and having a rocker arm pivot that extends between a pair of rocker arm mounts on the outside housing member; the outside housing member comprises a pin opening; the inside housing member comprises a pin opening; and the spool housing comprises a pin lock opening; and further comprising a stabilizing pin configured to be seated in the rocker arm slot when the stabilizing pin is inserted in the pin opening of the outside housing member, the pin opening in the inside housing member and the pin lock opening in the spool housing; and the split rewind housing is configured to be removed by depressing the rocker arm and lifting the stabilizing pin from the pin lock opening.

2. The device of claim 1, further comprising:

a pulley spring disposed in reverse-wind configuration inside the rewind housing, between the pulley and the outside housing member, for application of tension to the pulley in the split rewind housing.

3. The device of claim 1, wherein the split rewind housing is removable from the spool housing.

4. The device of claim 1, wherein the removable set of spools are configured to be removed from and replaced within the spool housing.

* * * * *